US007487827B2

(12) United States Patent
Tiernan

(10) Patent No.: US 7,487,827 B2
(45) Date of Patent: Feb. 10, 2009

(54) PROPELLANT CARTRIDGE WITH RESTRICTOR PLUGS FOR FRACTURING WELLS

(75) Inventor: John P. Tiernan, Newnan, GA (US)

(73) Assignee: Propellant Fracturing & Stimulation, LLC, Peachtree City, GA (US)

( * ) Notice: Subject to any disclaimer, the term of this patent is extended or adjusted under 35 U.S.C. 154(b) by 172 days.

(21) Appl. No.: 11/357,599

(22) Filed: Feb. 17, 2006

(65) Prior Publication Data

US 2006/0185839 A1 Aug. 24, 2006

Related U.S. Application Data

(60) Provisional application No. 60/654,349, filed on Feb. 18, 2005.

(51) Int. Cl.
*E21B 43/263* (2006.01)

(52) U.S. Cl. ..... 166/63; 166/308.1

(58) Field of Classification Search ..... 166/55, 166/297, 298, 177.5, 308.1, 63
See application file for complete search history.

(56) References Cited

U.S. PATENT DOCUMENTS 2,766,828 A 10/1956 Rachford, Jr.
2,831,429 A * 4/1958 Moore ..... 102/307
3,002,559 A 10/1961 Hanes
3,121,465 A * 2/1964 Stephens ..... 166/164
3,174,545 A * 3/1965 Mohaupt ..... 166/299
3,422,760 A * 1/1969 Mohaupt ..... 102/313
3,825,071 A * 7/1974 Veatch, Jr. ..... 166/308.1
4,018,293 A * 4/1977 Keller ..... 175/4.5
4,064,935 A * 12/1977 Mohaupt ..... 166/63
4,633,951 A 1/1987 Hill et al.
4,683,943 A 8/1987 Hill et al.
4,718,493 A 1/1988 Hill et al.
4,823,876 A 4/1989 Mohaupt
5,295,545 A 3/1994 Passamaneck
6,817,298 B1 * 11/2004 Zharkov et al. ..... 102/312

* cited by examiner

*Primary Examiner*—Kenneth Thompson
(74) *Attorney, Agent, or Firm*—Dorr, Carson & Birney, P.C.

(57) ABSTRACT

An apparatus for fracturing a well has a propellant charge held by a carrier, and upper and lower restrictor plugs secured to the carrier above and below the propellant charge, respectively. The restrictor plugs allow a restricted flow of combustion gases generated by the propellant charge to pass the restrictor plugs, but maintain sufficient pressure in the well between the restrictor plugs to fracture the formation surrounding the well.

17 Claims, 3 Drawing Sheets

TYPICAL WELL

TYPICAL WELL

PROPELLANT CARTRIDGE WITH RESTRICTOR PLUGS FOR FRACTURING WELLS

RELATED APPLICATION

The present application is based on and claims priority to the Applicant's U.S. Provisional Patent Application 60/654,349, entitled "Propellant Cartridge With Restrictor Plugs For Fracturing Wells," filed on Feb. 18, 2005.

BACKGROUND OF THE INVENTION

1. Field of the Invention

The present invention relates generally to the field of systems for fracturing wells. More specifically, the present invention discloses a propellant cartridge for fracturing a well that includes restrictor plugs above and below the propellant charge.

2. Statement of the Problem

Propellants generate high pressure gases that can be used to initiate and extend fractures in hydrocarbon-producing formations. These gases are produced when propellants are burned. The gases form at high temperature and pressure, and are subsequently cooled and condensed or otherwise lost to their surroundings. Conservation of energy tells us that some of the chemical bond energy of the propellant is converted to useful energy, but much of the energy is lost to the following: (a) up the well bore in the form of inertial displacement of the fluid column, which is a function of the fluid and casing characteristics; (b) up the well bore in the form of compression of the fluid column, which is a function of the fluid characteristics; (c) down the well bore in the form of compression of the fluid column, also a function of the fluid characteristics; (d) to the well casing and formation, in the form of expansion and contraction of the well casing and surrounding formation from the well bore pressures; (e) heat loss, in the form of heating the fluids, conversion to a vapor state, and heat loss to the casing and surrounding well formation; and (e friction losses as the gas vapors and fluid are pushed from the well bore into the formation, both through the well casing perforations and into the fractures which exist and are being propagated in the formation.

The more energy that can be directed to the formation to minimize these losses, the more useful work will be done on the formation. "Useful work" is hereby defined as that energy which extends fractures or cleans up existing fractures and perforations, allowing more of the hydrocarbons to flow back into the well bore. The problem is, therefore, to direct as much available energy as possible into the formation, in the form of pressurized gas, without damaging the well casing and surrounding formation.

Conventional packers have been employed in the past in hydraulic well fracturing and in using propellants to fracture wells. A packer typically is lowered to a desired depth in the well and actuated to completely block the well bore above or below the region to be fractured. U.S. Pat. No. 5,295,545 (Passamaneck) shows an example of propellant fracturing with a packer above the propellant charges.

Solution to the Problem. The present invention addresses this problem by placing restrictor plugs above and below the propellant charge with an outside diameter sized to deliver the appropriate amount of energy to fracture the surrounding formation without creating over-pressure conditions that might damage the well casing. The diameters of the restrictor plugs can be selected to allow more or less of the combustion gases to pass the restrictor plugs depending on specific well conditions.

For example, in an extremely impermeable formation with a high fracture extension pressure, the restrictor plug diameter can be reduced so that peak pressures would not exceed the casing burst pressure for extended durations, resulting in casing damage. In more permeable formations and those with lower fracture extension gradients, the restrictor plug diameter can be increased to achieve higher pressures, forcing more gas into the formation The restrictor plugs are secured to a carrier which bears the opposing forces exerted by the combustion gases on the restrictor plugs. These forces tend to offset one another, so that the assembly tends to remain in the desired vertical position within the well. In addition, only negligible forces are exerted on the well casing adjacent to the restrictor plugs, unlike conventional packers.

SUMMARY OF THE INVENTION

This invention provides an apparatus for fracturing a well that has a propellant charge held by a carrier, and upper and lower restrictor plugs secured to the carrier above and below the propellant charge, respectively. The restrictor plugs allow a restricted flow of combustion gases generated by the propellant charge to pass the restrictor plugs, but maintain sufficient pressure in the well between the restrictor plugs to fracture the formation surrounding the well.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
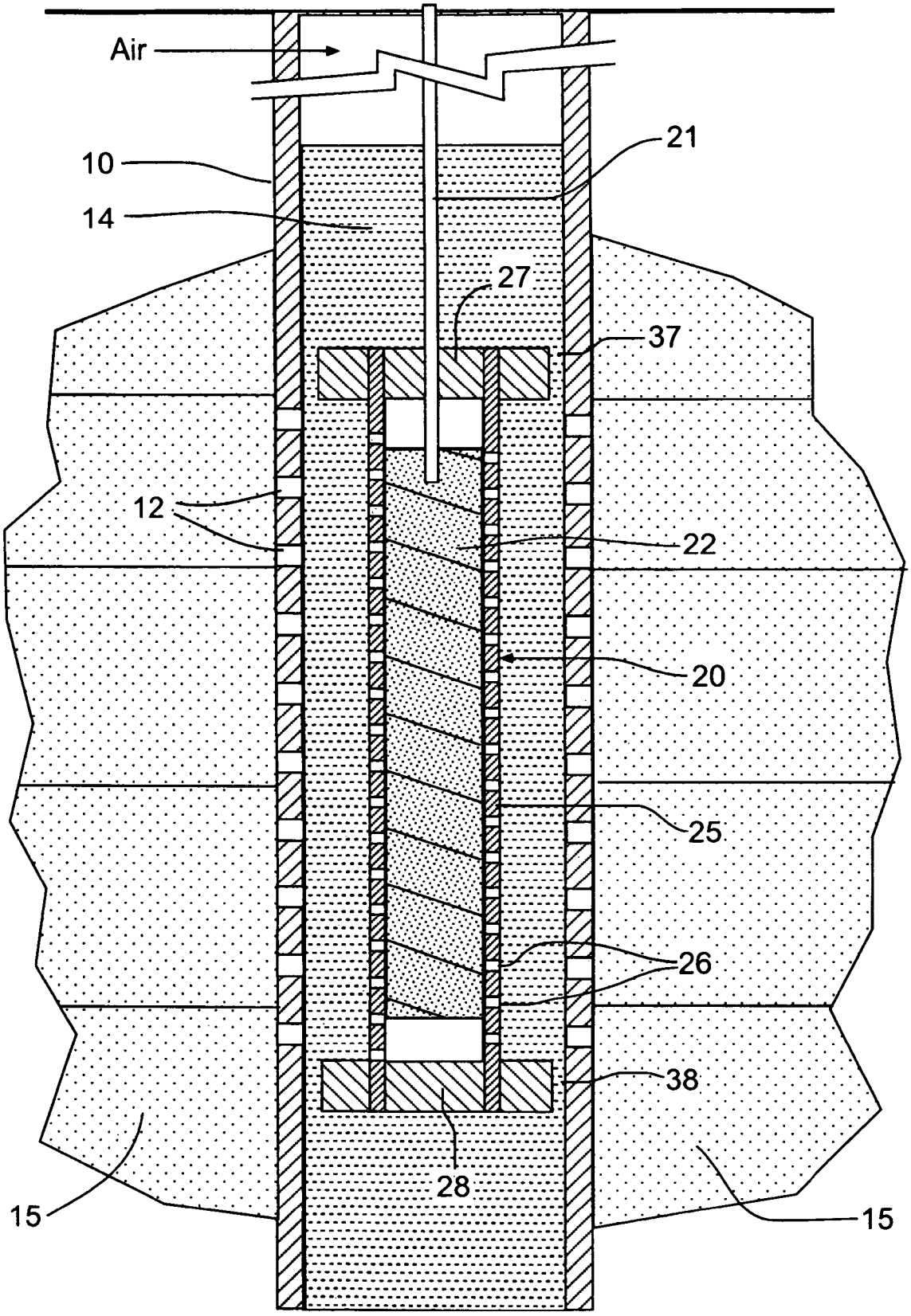
FIG. 1 is a cross-sectional view of the propellant assembly in a well prior to ignition of the propellant.
Figure 3:
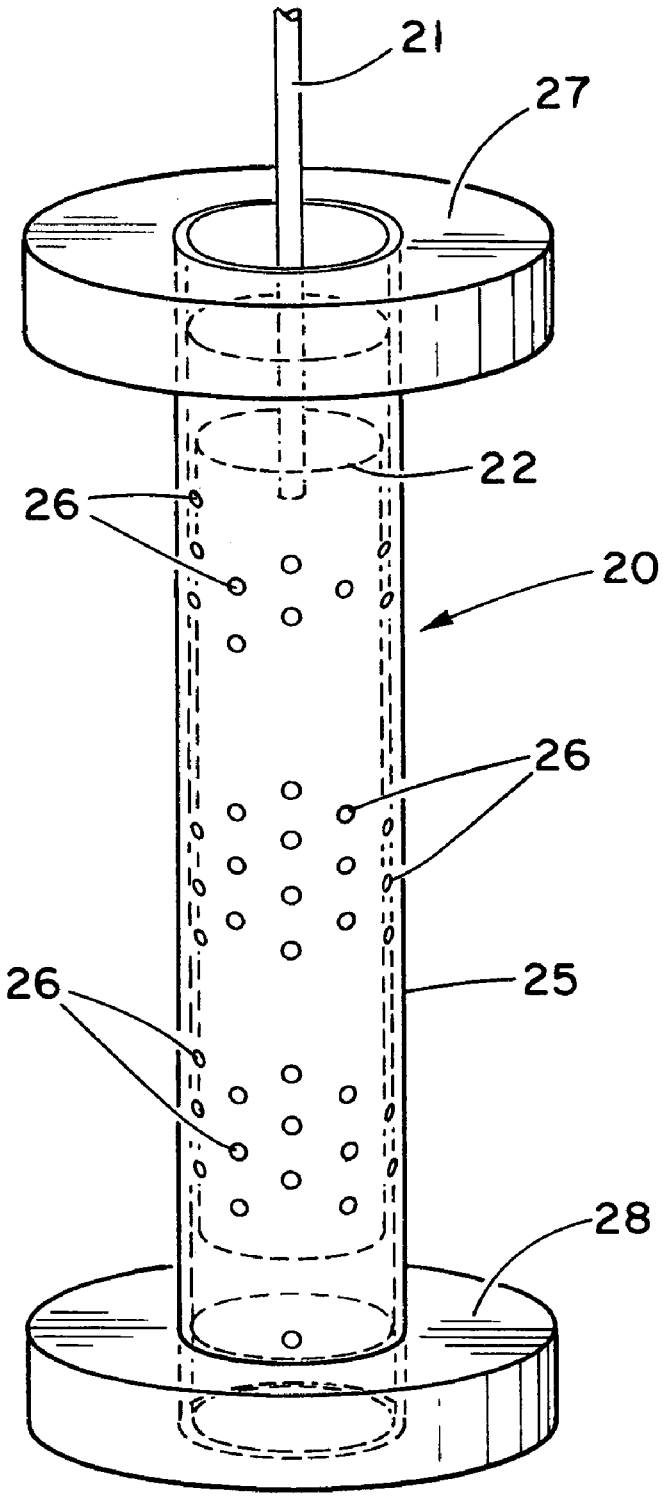
FIG. 3 is a perspective view of the propellant assembly.

Turning to FIG. 1, a cross-sectional view is shown of the propellant assembly 20 in a well 10 prior to ignition of the propellant charge 22. FIG. 3 is a corresponding perspective view of the propellant assembly 20. The major components of the propellant assembly 20 are a propellant charge 22, carrier 25, and upper and lower restrictor plugs 27 and 28.

The carrier 25 provides a structural framework for the other components. In the embodiment shown in the drawings, the carrier 25 is a tube that holds the propellant charge 22 and has a number of perforations or openings 26 to allow the escape of combustion gases produced by the burning propellant from within the carrier. This configuration has the advantage that the carrier encloses and protects the propellant charge 22 to minimize the risk of damage during transportation and deployment of the propellant assembly 20. The vertical length of the carrier 25 is designed to span the region of the well 10 that is to be fractured.

The propellant charge 22 can be any conventional propellant capable of rapid combustion to produce large volume of combustion gases. In the embodiment shown in the drawings, a propellant charge 22 having a generally cylindrical shape is placed inside the mid-portion of the carrier 25. However, the size and shape of the propellant charge, as well as the number of propellant charges are largely a matter of design choice. The propellant charge 22 can be ignited using any of a variety of conventional techniques.

Restrictor plugs 27 and 28 are secured to the upper and lower portions of the carrier 25 with the propellant charge 22 between the restrictor plugs 27, 28. After the assembly has been lowered into the well, these restrictor plugs 27, 28 define the upper and lower bounds of the region in the well to be fractured. The restrictor plugs 27, 28 are designed to allow a restricted flow of combustion gases generated by the burning propellant charge 22 to pass the restrictor plug (i.e., up the well for the upper restrictor plug 27, or down the well for the lower restrictor plug 28). For example, the restrictor plug 27, 28 can have a labyrinth seal or a series circumferential channels to create more friction as the combustion gases pass between the restrictor plug 27, 28 and the well casing 10.

Figure 2:
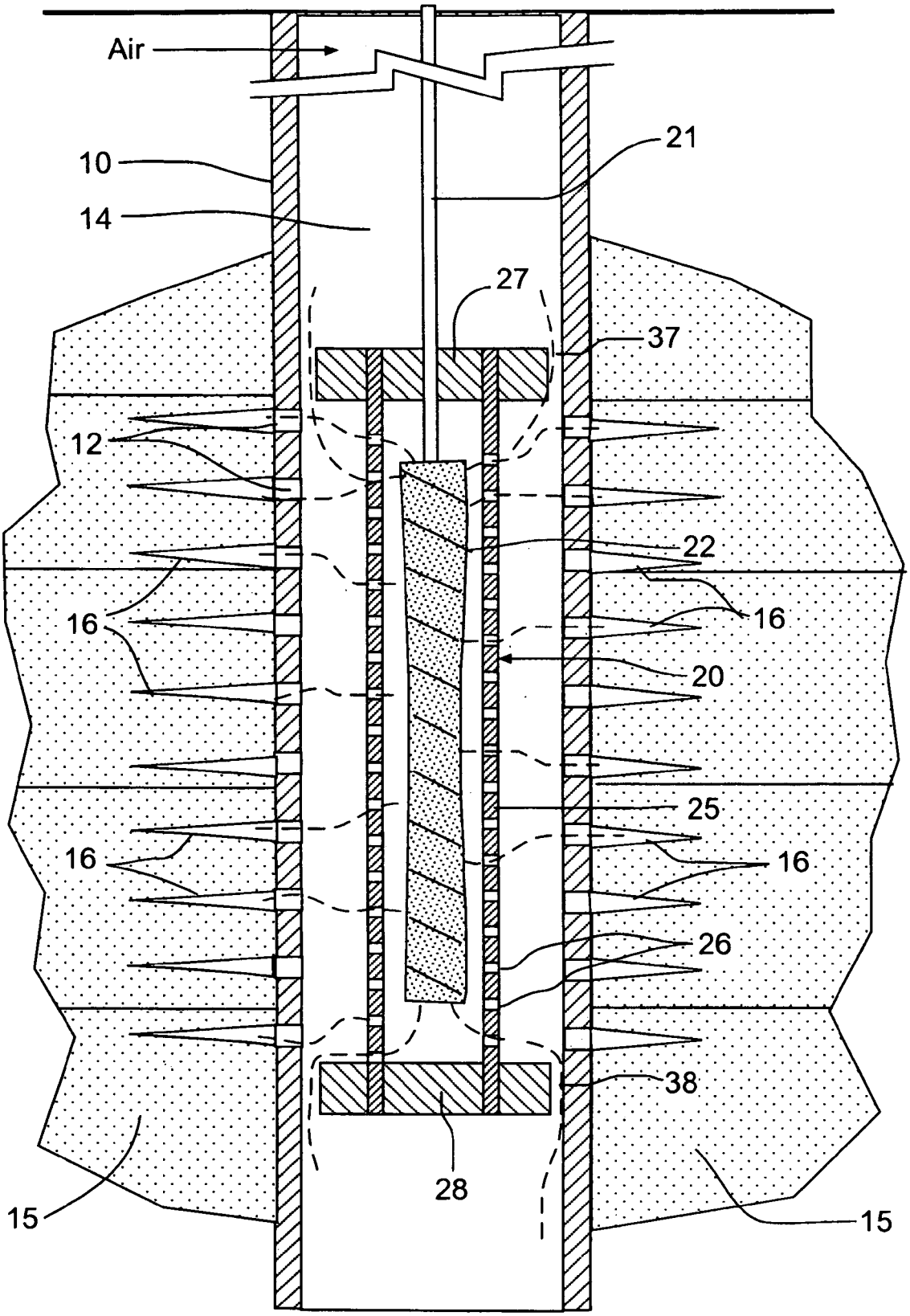
FIG. 2 is a cross-sectional view of the propellant assembly in a well after ignition of the propellant.

By modeling the burn characteristics of the propellant charge 22 based on its size, geometry, well conditions, and chemical composition, it is possible to estimate the generation of combustion gases as a function of time. The restrictor plugs 27, 28 can then be designed to maintain sufficient pressure within the well between the upper and lower restrictor plugs 27, 28 to fracture the formation 15 surrounding the well, while limiting the maximum pressure within the fracture zone between the restrictor plugs to avoid over-pressure and possible damage to the well. The resulting fractures 16 in the surrounding formation 15 are shown in FIG. 2. Preferably, this is accomplished by selecting the size or diameter of the restrictor plugs 27, 28 to be smaller than the inside diameter of the well casing 10. This creates a gap 37, 38 between the periphery of the restrictor plug 27, 28 and the well casing 10 for passage of combustion gases, as shown in FIG. 2.

Optionally, perforations or passageways could be built into the restrictor plugs 27, 28 to allow combustion gases to flow through or around the restrictor plug. However, perforation size and density must be taken into account when sizing the restrictor plugs 27, 28. If perforation size and density are too small, a choked flow condition can result whereby the velocity of gas through the perforations would be limited to the speed of sound, and the pressure inside the region between the restrictor plugs 27, 28 would increase to a point that might cause damage to the well casing 10 or the surrounding formation 15. This could also be dealt with via proper sizing of the restrictor plug 27, 28. As an additional precautionary measure, a rupture disk can be placed in the restrictor plug 27, 28 to fail and release pressure to avoid casing or formation damage.

The following is a discussion of the steps used in fracturing a well with the present invention. The well is initially drilled and cased, and perforations 12 are created in the well casing 10 adjacent to the zone to be fractured using conventional technology. The propellant assembly 20 is then be lowered to a desired depth in the well 10 by a wire line or tubing 21. The upper and lower restrictor plugs 27, 28 are positioned to block a selected region of the well to be fractured (i.e., a fracture zone). It should be noted that the restrictor plugs 27, 28 are not fixed to the well casing 10, but rather move together with the propellant assembly 20. This enables the propellant assembly 20 to go into and out of a well easily in one piece, and simplifies operation. Optionally, a tamp fluid 14 can be placed into the well as shown in FIG. 1.

After insertion of the propellant assembly 20 into the well 10, the propellant charge 22 ignited to generate combustion gases, as shown in FIG. 2. This rapidly increases the pressure in the fracture zone between the restrictor plugs 27, 28. A portion of the tamp fluid 14 and combustion gases are driven through the perforations 12 in the well casing 10 to propagate fractures 16 in the surrounding formation. A portion of the tamp fluid 14 and combustion gases escape through the gaps 37, 38 between the restrictor plugs 27, 28 and the well casing 10, which limits the resultant pressure spike. The restrictor plugs 27, 28 do not significantly contact the casing well, which eliminates enormous stress concentrations in the casing associated with conventional packers. In contrast, the axial forces exerted on a conventional packer are transmitted to the well casing and can be large enough to damage the casing.

In addition, the opposing axial forces exerted by the combustion gases on the faces of the restrictor plugs 27, 28 are transmitted by the carrier 25 and substantially offset one another. This greatly reduces any tendency for the propellant assembly 20 to jump vertically.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. An apparatus for fracturing a geological formation outwardly of a well having a perforated casing, said apparatus comprising:

a carrier positioned within said perforated casing;

a propellant charge held by the carrier;

an upper restrictor plug secured to the carrier above the propellant charge allowing a restricted flow of combustion gases generated by the propellant charge to pass the upper restrictor plug; and a lower restrictor plug secured to the carrier below the propellant charge allowing a restricted flow of combustion gases generated by the propellant charge to pass the lower restrictor plug, whereby the upper and lower restrictor plugs maintain sufficient pressure in the well between the upper and lower restrictor plugs to cause said combustion gases to pass outwardly through the existing perforations of said casing to fracture the formation surrounding the well.

2. The apparatus of claim 1 wherein the propellant charge is contained within the carrier, and wherein the carrier further comprises perforations allowing the escape of combustion gases from the propellant charge.

3. The apparatus of claim 1 wherein the upper restrictor plug has dimensions creating a gap between the upper restrictor plug and the well casing.

4. The apparatus of claim 1 wherein the upper restrictor plug has a diameter less than the inside diameter of the well casing.

5. The apparatus of claim 1 wherein the lower restrictor plug has dimensions creating a gap between the lower restrictor plug and the well casing.

6. The apparatus of claim 1 wherein the lower restrictor plug has a diameter less than the inside diameter of the well casing.

7. The apparatus of claim 1 wherein the dimensions of the upper and lower restrictor plugs are selected to prevent the pressure in the well between the upper and lower restrictor plugs from exceeding a predetermined maximum pressure.

8. An apparatus for fracturing a geological formation outwardly of a well having a perforated casing, said apparatus comprising:

a carrier positioned within said perforated casing;

a propellant charge held by the carrier;

an upper restrictor plug secured to the carrier above the propellant charge and having a diameter less than the inside diameter of the well casing to form a gap allowing a restricted flow of combustion gases generated by the propellant charge to pass the upper restrictor plug; and a lower restrictor plug secured to the carrier below the propellant charge and having a diameter less than the inside diameter of the well casing to form a gap allowing a restricted flow of combustion gases generated by the propellant charge to pass the lower restrictor plug, whereby the upper and lower restrictor plugs maintain sufficient pressure in the well between the upper and lower restrictor plugs to cause said combustion gases to pass outwardly through the existing perforations of said casing to fracture the formation surrounding the well and the pressures exerted by the combustion gases on the upper and lower restrictor plugs are transmitted through the carrier to substantially offset one another to substantially maintain the carrier in place along said casing.

9. The apparatus of claim 8 wherein the propellant charge is contained within the carrier, and wherein the carrier further comprises perforations allowing the escape of combustion gases from the propellant charge.

10. The apparatus of claim 8 wherein the dimensions of the upper and lower restrictor plugs are selected to prevent the pressure in the well between the upper and lower restrictor plugs from exceeding a predetermined maximum pressure.

11. The apparatus of claim 8 wherein the carrier comprises a perforated tube containing the propellant charge.

12. An apparatus for fracturing a geological formation outwardly of a well having a perforated casing, said apparatus comprising:

a tubular carrier positioned within said perforated casing and having perforations;

a propellant charge held within the carrier, said perforations allowing the escape of combustion gases produced by the propellant charge from within the carrier;

an upper restrictor plug secured to the carrier above the propellant charge allowing a restricted flow of combustion gases generated by the propellant charge to pass the upper restrictor plug; and a lower restrictor plug secured to the carrier below the propellant charge allowing a restricted flow of combustion gases generated by the propellant charge to pass the lower restrictor plug, whereby the upper and lower restrictor plugs maintain sufficient pressure in the well between the upper and lower restrictor plugs to cause said combustion gases to pass outwardly through the existing perforations of said casing to fracture the formation surrounding the well.

13. The apparatus of claim 12 wherein the upper restrictor plug has dimensions creating a gap between the upper restrictor plug and the well casing.

14. The apparatus of claim 12 wherein the upper restrictor plug has a diameter less than the inside diameter of the well casing.

15. The apparatus of claim 12 wherein the lower restrictor plug has dimensions creating a gap between the lower restrictor plug and the well casing.

16. The apparatus of claim 12 wherein the lower restrictor plug has a diameter less than the inside diameter of the well casing.

17. The apparatus of claim 12 wherein the dimensions of the upper and lower restrictor plugs are selected to prevent the pressure in the well between the upper and lower restrictor plugs from exceeding a predetermined maximum pressure.

* * * * *